US005233330A

United States Patent [19]

Hase

[11] Patent Number: 5,233,330

[45] Date of Patent: Aug. 3, 1993

[54] ALARM CIRCUITS TO INDICATE THE OPEN STATUS OF CIRCUIT BREAKERS OR FUSES FOR DC TELECOM AND AC DISTRIBUTION CIRCUITS

[76] Inventor: Alfred M. Hase, 6 Manorwood Dr., Scarborough, ON, Canada

[21] Appl. No.: 614,237

[22] Filed: Nov. 16, 1990

[51] Int. Cl.[5] ..... G08B 21/00

[52] U.S. Cl. ..... 340/638; 335/17

[58] Field of Search ..... 340/638, 639; 335/17; 361/88, 170

[56] References Cited

U.S. PATENT DOCUMENTS

| | | | |
|---|---|---|---|
| H248 | 4/1987 | Middlebrooks | 340/638 |
| 3,045,167 | 7/1962 | Colaiaco | 340/638 |
| 3,512,073 | 5/1970 | South | 340/638 |
| 3,729,656 | 4/1973 | Luquain | 340/638 |
| 4,581,674 | 4/1986 | Brzozowski | 340/639 |

FOREIGN PATENT DOCUMENTS

| | | | |
|---|---|---|---|
| 2724358 | 11/1978 | Fed. Rep. of Germany | 340/638 |
| 66048 | 7/1950 | Netherlands | 340/638 |

OTHER PUBLICATIONS

*Communications Standard Dictionary,* Mott, Weik, pp. 794, 795.

*Primary Examiner*—Edward L. Coles, Sr.
*Assistant Examiner*—Jill Jackson
*Attorney, Agent, or Firm*—Donald E. Hewson

[57] ABSTRACT

An alarm circuit is provided which takes the place of auxiliary contacts that are generally used in association with circuit breakers or fuses to provide an alarm warning in the event that the circuit breaker or fuse in series with a load has opened for any reason. The alarm circuit is provided with a high resistance resistor that is connected to the load end of the circuit breaker, and at the other end of the resistor to a high gain amplifier or solid state switch. The output of the high gain amplifier is connected to a remote signal relay, which may be DC relay or an AC relay. The arrangement is such that the high gain amplifier becomes conductive in the event that the circuit breaker opens, thereby causing an alarm indication. Indicators are associated with the circuits, including an LED to provide a local signal indicative of the fact that the relay has changed its state. A remote alarm circuit is driven by the change of state of the remote signal delay. Because the alarm circuit monitors the circuit breaker itself, a true indication of the fact that the circuit breaker has opened is assured.

6 Claims, 12 Drawing Sheets

RECTIFIED AC-BREAKER ALARM (SERIES DC-RELAY)

POSITIVE GROUND DC-BREAKER ALARM ( SERIES RELAY )

POSITIVE GROUND DC-BREAKER ALARM ( SHUNT RELAY )

NEGATIVE GROUND DC-BREAKER ALARM ( SERIES RELAY )

NEGATIVE GROUND DC-BREAKER ALARM ( SHUNT RELAY )

POSITIVE GROUND DC-BREAKER ALARM ( SHUNT RELAY )

NEGATIVE GROUND DC-BREAKER ALARM ( SHUNT RELAY )

RECTIFIED AC-BREAKER ALARM (SERIES DC-RELAY)

RECTIFIED AC-BREAKER ALARM (SERIES AC-RELAY)

RECTIFIED AC-BREAKER ALARM (SERIES DC-RELAY)

UNGROUNDED (FLOATING) DOUBLE POLE DC BREAKER ALARM
(SERIES DC-RELAY)

UNGROUNDED (FLOATING) DOUBLE POLE DC BREAKER ALARM
(SERIES DC-RELAY)

ALARM CIRCUITS TO INDICATE THE OPEN STATUS OF CIRCUIT BREAKERS OR FUSES FOR DC TELECOM AND AC DISTRIBUTION CIRCUITS

FIELD OF THE INVENTION

This invention relates to alarm circuits for voltage systems across which a load is connected, where the load is connected in series with at least one circuit breaker or fuse to protect the load, and where it is intended for an alarm signal to be generated when the circuit breaker or fuse is opened. The present invention provides solid state operating alarm circuits. Moreover, the present invention provides for such an alarm circuit generally described above to operate in either a direct current system or an alternating current system.

BACKGROUND OF THE INVENTION

It is normal, particularly in telecom systems, for a DC power system to be provided, with the load being connected across the DC voltage. Other systems that have critical loads may, of course, be connected across AC systems.

In either event, where the load is a critical load such as components of a telecom system, the load is protected by a circuit breaker or fuse which is in series with it across the voltage system. Occasionally, the load may be between a pair of ganged circuit breakers. The circuit breaker or fuse is provided and is sized so that it will open if the load current through the load—and, of course, through the circuit breaker or fuse—exceeds the predetermined current handling capacity of the circuit breaker or fuse.

In the following discussion, the words "circuit breaker" and "fuse" are used essentially interchangeably, and indicate a device which is designed and intended to open under a predetermined current condition to protect the load with which it is in series.

Of course, if the circuit breaker opens for whatever reason, the operator of the system wants to have some alarm indication of the fact that the circuit breaker has opened. Remedial action may be taken, or the load may be examined to determine why it suddenly required a higher current than normal.

Thus, the use of a circuit breaker protects the load, and the generation of some kind of signal is required to indicate to the operator that the circuit breaker has opened to protect the load. The usual arrangement has been the use of auxiliary contacts or indicating fuses which are physically located in the circuit breaker; usually in such a manner that the auxiliary contacts are open when the circuit breaker is closed, and the auxiliary contacts are closed when the circuit breaker opens. The closing of the auxiliary contacts makes another circuit which is independent of the load although it may be across the same voltage system, and in that other circuit an alarm signal generating means is provided.

However, the quality control, and indeed the design, of auxiliary contacts is such that it can not always be assured that the auxiliary contacts will make—that is, they will close—when they should. If that is the case, then the circuits which rely on the operation of the auxiliary contacts are neither trustworthy nor fail safe.

It should also be noted that, particularly in telecom circuits, the circuit breaker which protects the critical load is arranged only at one side of the system. Usually, the positive bus of a DC system is grounded, and the load is placed between the positive and negative sides in series with the circuit breaker which is at the negative end of the load. In a central switching station for such as a telephone system, many hundreds of mechanical circuit breakers with their auxiliary contacts may be used; and clearly, it is less than satisfactory for there to be less than 100% certainty that failure of any critical load and the opening of a circuit breaker to protect that load, will produce a signal which signifies that fact.

In some circumstances, usually higher voltage systems, the negative side of the system may be grounded. Under other circumstances, the voltage system may be an alternating current system, usually with the neutral side of the system connected to ground. In still other circumstances, the system may be operating as an ungrounded or floating direct current system; and in that case, it is usual for the load to be protected at each side by a breaker which is ganged or connected such as through a double pole tie to the other breaker—so that if the one breaker opens, the other breaker will also open.

What the present invention provides is an alarm circuit which directly monitors opening of the circuit breaker itself, not the mechanical auxiliary contacts or indicating fuse that might be used in association with the circuit breaker. Moreover, the present invention provides such an alarm circuit which is fully solid state, thereby precluding any possibility of mechanical failure.

Therefore, the present invention provides an alarm circuit which is arranged to provide a status or alarm signal at least when the circuit breaker in series with a critical load across a voltage system has opened. The alarm circuit includes a high resistance resistor which is arranged to drive a high gain amplifier, which functions as a solid state switch; the circuit being arranged therefore as a status monitor. The high resistance resistor is connected at its first end to the load end of the circuit breaker, and at its second end to the input of the high gain amplifier. In turn, the high gain amplifier is connected at its output to one side of a remote signal relay or switch which may be solid state such as an SCR or triac, or it may be a conventional relay. The other side of the remote signal relay is connected to one side of the voltage system. The connection of the high resistance resistor to the input of the high gain amplifier is such that the high gain amplifier is maintained in a substantially non-conductive condition. As described hereafter, if the breaker opens, then the high gain amplifier changes its state to become conductive—in another words, its output goes from low to high. If the remote signal relay receives a high output from the high gain amplifier, which is indicative of the circuit breaker having opened, then the remote signal relay will change its state. If so, then means are associated with the solid state relay to provide a signal which is indicative of the change of state of that relay. Since the remote signal relay will not change its state unless the circuit breaker opens, then the signal is indicative of the fact that the circuit breaker has opened.

More particularly, the high gain amplifier itself functions as a solid state switch, driving another relay—which is the remote signal relay discussed above. Still further, the circuits of the present invention provide for both a local alarm and a remote alarm. The local alarm is generally in the form of an LED in the circuits, and the remote alarm takes its signal from the remote signal relay so that it is isolated from the alarm circuits of the present invention, but operative with them. The LED is in series with the output of the high gain amplifier, so that when the high gain amplifier becomes conductive, the LED becomes illuminated.

As will be described in greater detail hereafter, the remote signal relay may be in series with the high gain amplifier, or it may be in parallel (shunt) with the output of the high gain amplifier. Moreover, as noted, the alarm circuits of the present invention may be adapted to work with a grounded or a floating DC voltage system, or an AC voltage system; and in an AC voltage system the remote signal relay may be an AC relay or a DC relay.

By using a solid state alarm circuit in keeping with the present invention, a much higher inherent reliability is assured. Obviously, the MTBF (Mean Time Between Failures) rating of a resistor or a transistor, (or an FET functioning as a high gain amplifier or as a solid state relay), is much higher than the MTBF rating of mechanical auxiliary contacts or even mechanical relays. Because of the arrangement of the present invention, it is the circuit breaker itself which is monitored by the alarm circuit, and not the auxiliary contacts which heretofore have been monitored by alarm circuits especially in telecom systems. The present invention assures that in all events a local alarm indication (the LED) is made when the circuit breaker opens, and it assures that by using a remote signal relay at the output of its solid state relay or high gain amplifier that a remote alarm may be isolated from but driven by the present alarm circuits.

BRIEF DESCRIPTION OF THE DRAWINGS

The present invention will be described in greater detail hereafter, in association with the accompanying drawings, in which.

DESCRIPTION OF THE PREFERRED EMBODIMENTS

Figure 1:
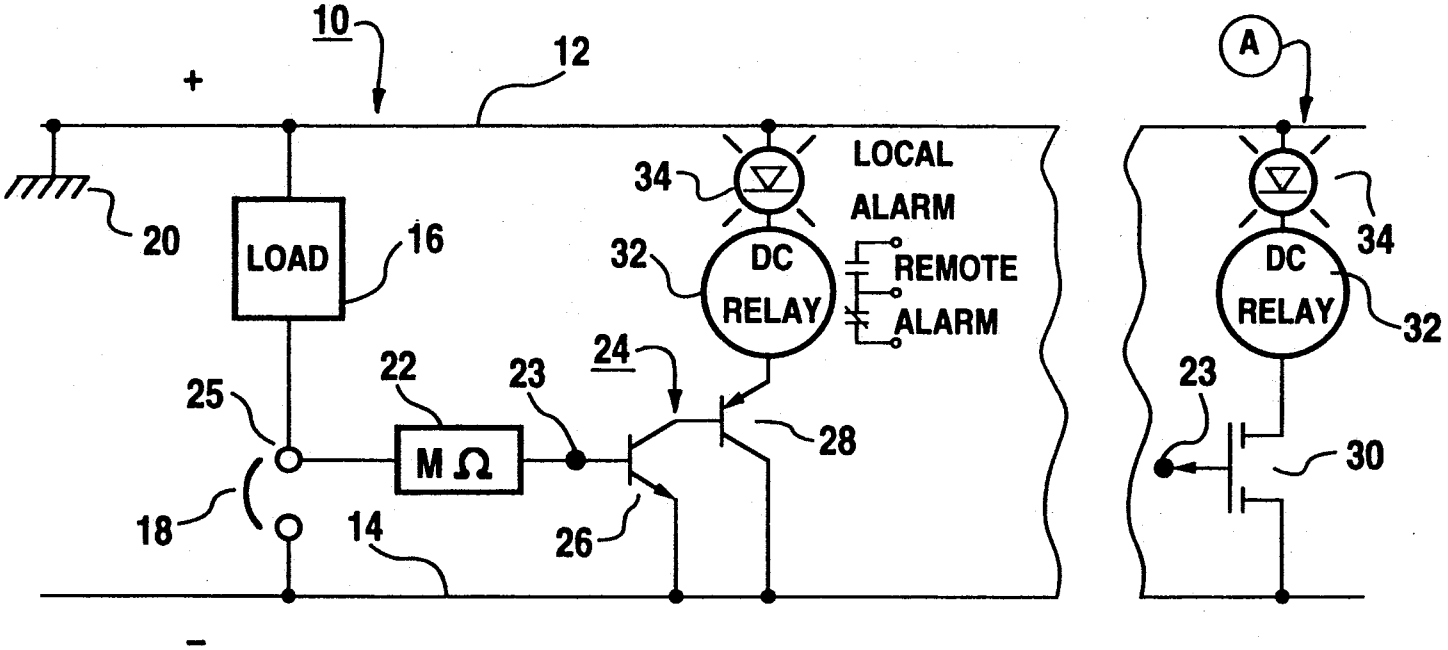
FIG. 1 shows a first typical circuit of an alarm circuit according to the present invention in a DC operating system, with part (A) showing an alternative high gain amplifier, the remote signal relay being in series with the high gain amplifier in both alternatives shown in FIG. 1.

Referring to FIG. 1, the principals of the present invention are now discussed.

A typical telecom system may be set up in much the same manner as is shown in FIG. 1. A DC operating system is shown at 10, having a positive bus 12 and a negative bus 14. Between the buses 12 and 14 is a load 16, arranged in series with a circuit breaker 18. It will be noted that the positive bus 12 is grounded at 20.

A high resistance resistor 22 is connected to the load end of the circuit breaker 18. The other end of the high resistance resistor 22 is connected through point 23 to a high gain amplifier shown generally at 24. A typical high gain amplifier may comprise a PNP transistor 26 and NPN transistor 28; or an alternative typical high gain amplifier may comprise a FET 30 as shown in alternative (A) also indicated in FIG. 1. The high gain amplifier 24 or 30 functions as a solid state switch, which changes its state from non-conductive to conductive in the event that the circuit breaker 18 (or fuse) opens, as discussed hereafter.

In the FIG. 1 embodiments, a DC relay 32 is connected to the output of the high gain amplifier 24 at one side, the other side of the DC relay being connected to the positive bus 12. An LED 34 is shown and is discussed hereafter. The DC relay 32 functions as a remote signal relay, and the LED 34 functions as a local alarm indicator, as discussed hereafter.

The DC relay 32 is normally arranged so that it is in a non-conducting state. That is because the high gain amplifier or solid state switch 24 or 30 is not conducting, and if it is not conducting then there is no current to drive the DC relay 32 into a conductive state. When the high gain amplifier 24 or 30 becomes conductive, then the DC relay 32 is conductive, and the LED 34 is illuminated, thereby giving a local indication of the fact that an alarm condition exists.

The resistance of resistor 22 is very much greater than the resistance of the load 16. Generally, the resistance 22 may be chosen so that the current flowing through it is minimal (being perhaps in the range of 10 to 40 microamps) when the circuit breaker 18 is open.

However, when the circuit breaker 18 is closed—that is, current is flowing through the load 16 and the load is operating in its normal condition—then there is essentially zero voltage drop across the circuit breaker 18 and therefore there is no bias across the high gain amplifier or solid state relay 24 (or 30). For example, there is no bias across the transistor 26 as shown in FIG. 1, and thus the transistor 28 is latched open or off. Therefore, the high gain amplifier 24 (or 30) is non-conductive. Thus, at best there is leakage current flowing through the resistor 22, there is no bias at the high gain amplifier 24 (or 30) sufficient to change its state to become conductive. Thus, the high gain amplifier 24 (or 30), which operates essentially as a solid state switch, is non-conductive.

In that case, the voltage at point 25—which is the common point of the load 16, the circuit breaker 18, and the resistor 22—is essentially the same as the voltage of the negative bus 14. If, however, the circuit breaker 18 should open, then the voltage at that common point 25 will essentially become the voltage of the positive bus 12. In that event, the high gain amplifier 24 will become conductive. That, in turn, results in the DC remote signal relay 32 becoming conductive, and the LED 34 is illuminated.

The circuit of FIG. 1 is arranged so that the operation of the DC remote signal relay 32 is that of a pick-up relay. In other words, in the event that the circuit breaker 18 opens and the high gain amplifier 24 or 30 (operating as a solid state relay) becomes conductive, then the DC remote signal relay 32 becomes conductive—meaning that the relay picks up. Thus, a signal from the remote signal relay 32 may be sent to an isolated remote signal circuit to indicate the open condition of the circuit breaker 18. At the same time, as noted, the LED 34 has become illuminated, so that a local alarm signal of the open condition of the circuit breaker 18 is also given.

Figure 2:
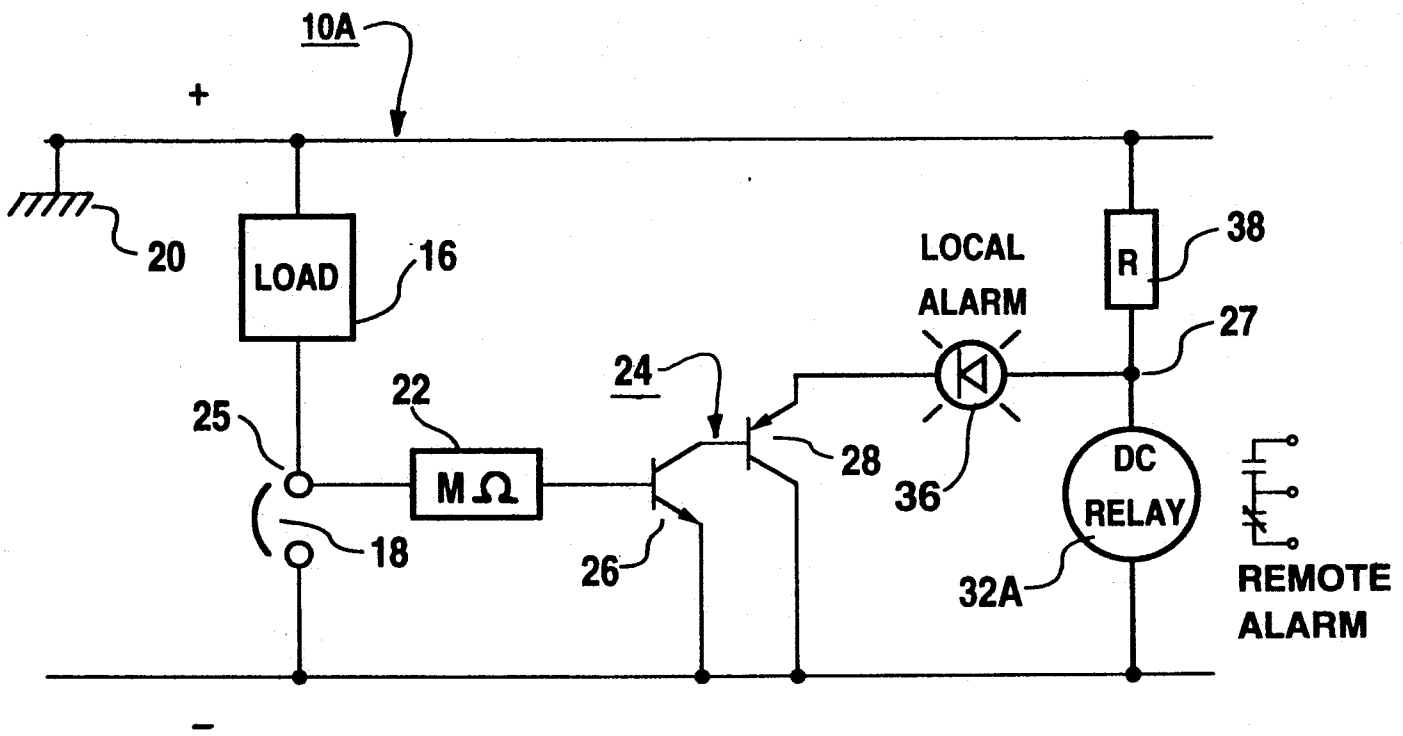
FIG. 2 is an alternative alarm circuit operating in a DC system, where the remote signal relay is in parallel to the output of the high gain amplifier.

FIG. 2 shows a similar circuit to that of FIG. 1, except for the placement of the remote signal relay 32A. In FIG. 2, and all other Figures, like components are shown with the same reference numerals.

In FIG. 2, the remote signal relay 32A is shown in parallel with the output of the high gain amplifier 24. In this case, it is connected through a voltage offset resistor 38 to the positive bus 12. The operation of the circuit of FIG. 2 is otherwise similar to that of the operation of FIG. 1. Clearly, the high gain amplifier 24 could be a FET as well, as shown in FIG. 5.

Figure 5:
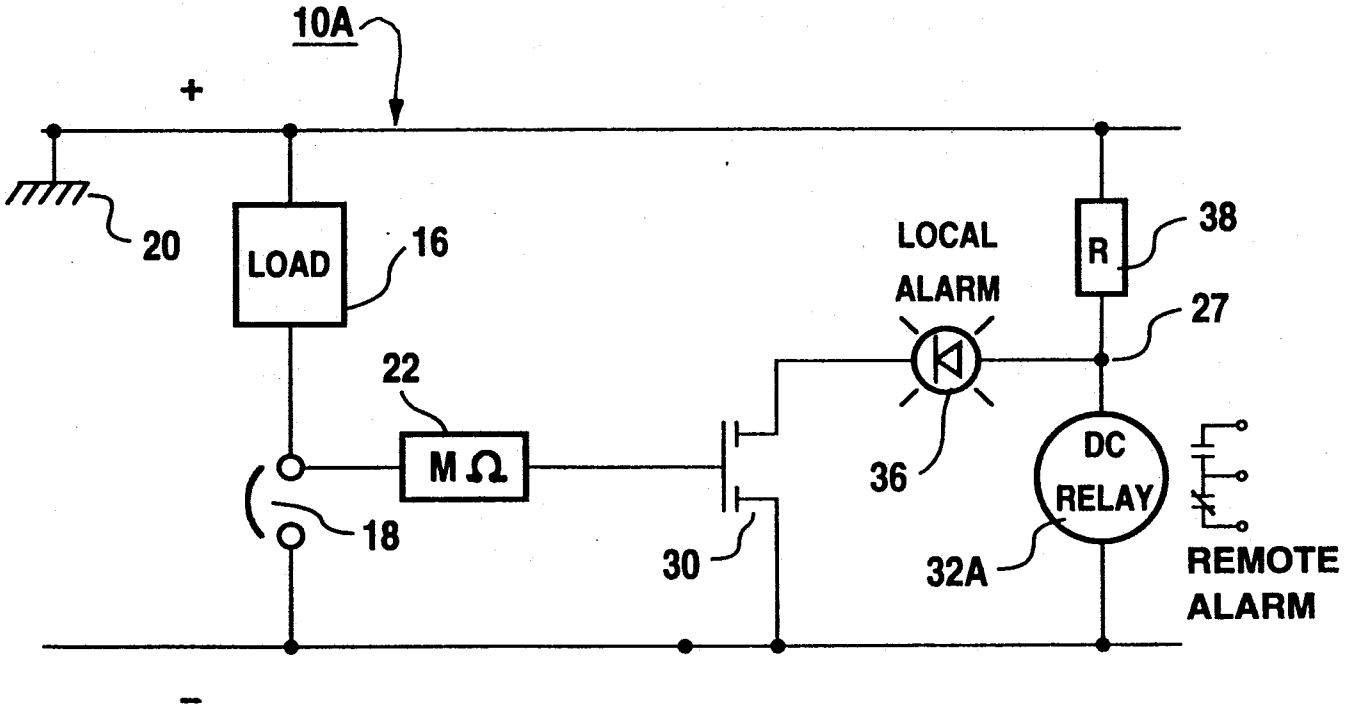
FIG. 5 is similar to FIG. 2, showing an alternative high gain amplifier.

It should be noted that the operation of the circuits of FIGS. 2 and 5 is, however, such that the remote signal relay 32A functions in a drop-out manner. The voltage at the juncture 27 between the positive side of the LED 36 and the lower side of the offset resistor 38 changes if the circuit breaker 18 opens, the drop out contacts of the relay 32A operate, and the LED 36 becomes illuminated.

Figure 3:
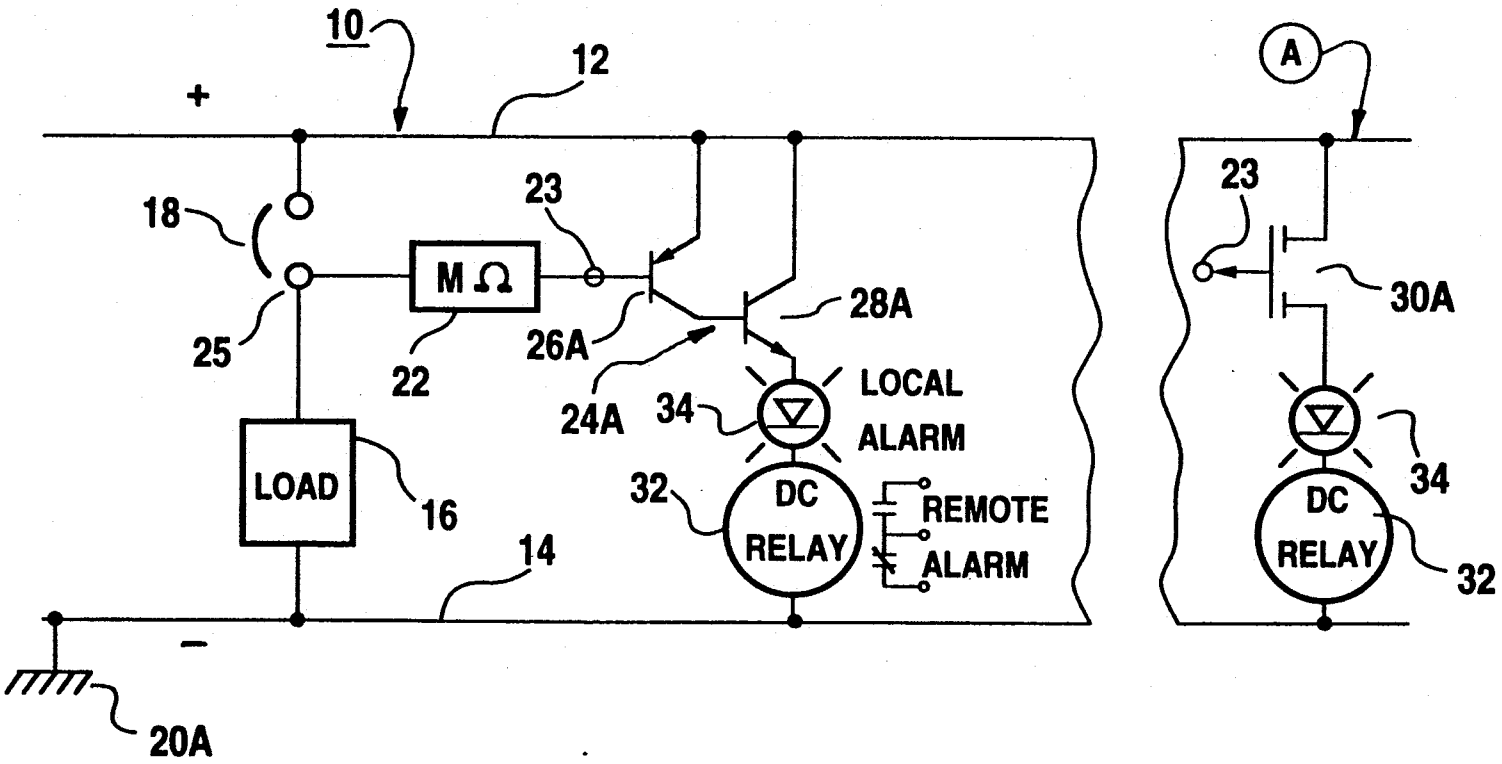
FIG. 3 is similar to FIG. 1, but shows a negative ground DC system.

FIG. 3 is very similar to FIG. 1, showing an alarm circuit having an exemplary transistor high gain amplifier 24A and an alternative exemplary high gain amplifier in part (A) as a FET 30A. The significant difference, however, is that FIG. 3 shows the alarm circuits operating in a negative ground DC voltage system, where the negative side 14 of the system is grounded at 20A. Likewise, transistor 26A is an NPN transistor, and transistor 28A is PNP. The operation of the circuit of FIG. 3 is the same as discussed above with respect to FIG. 1.

Figure 4:
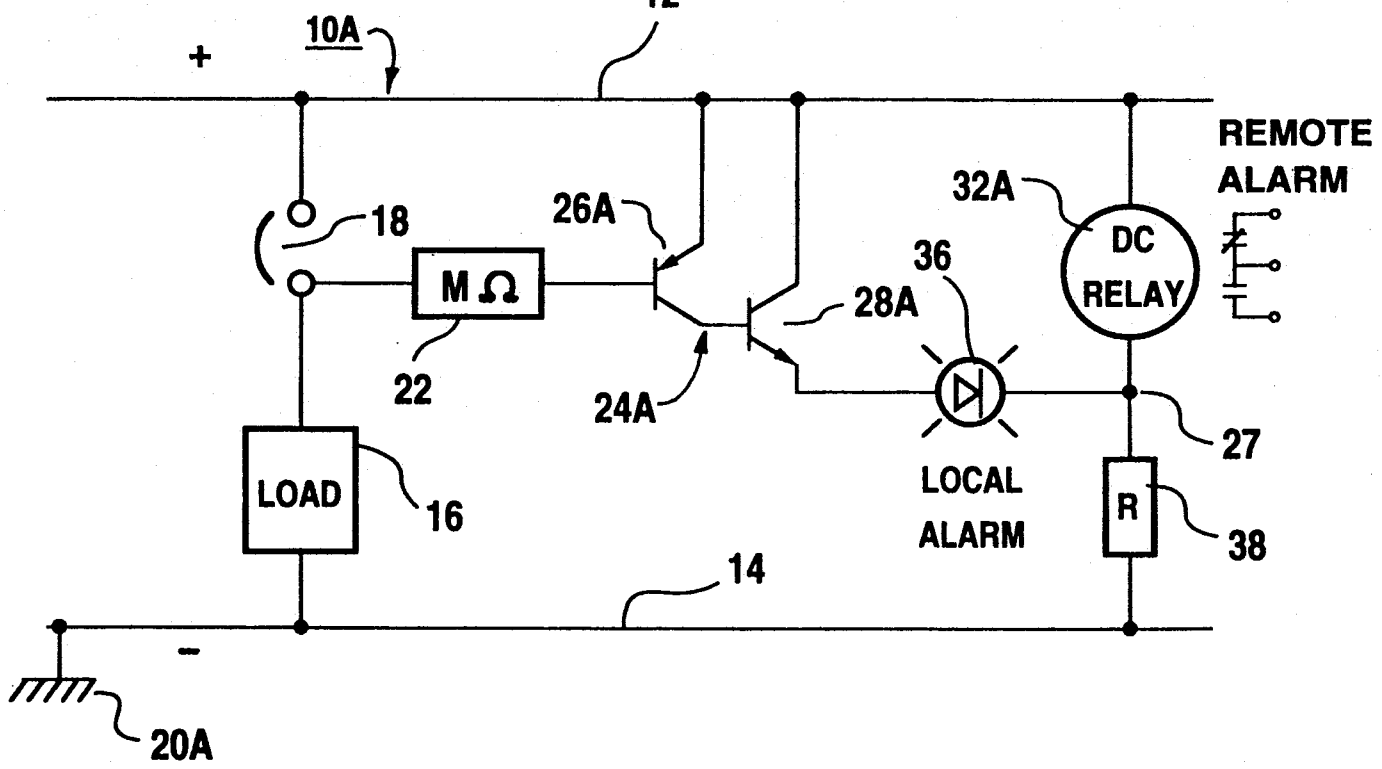
FIG. 4 is similar to FIG. 2, but shows a negative ground DC system.

In similar manner, FIG. 4 shows a circuit which is similar to FIG. 2, operating in a negative ground DC voltage system. Once again, the polarity of the transistors which comprise the high gain amplifier 24A are reverse to those as shown in FIG. 2, and are similar to those as shown in FIG. 3.

Figure 6:
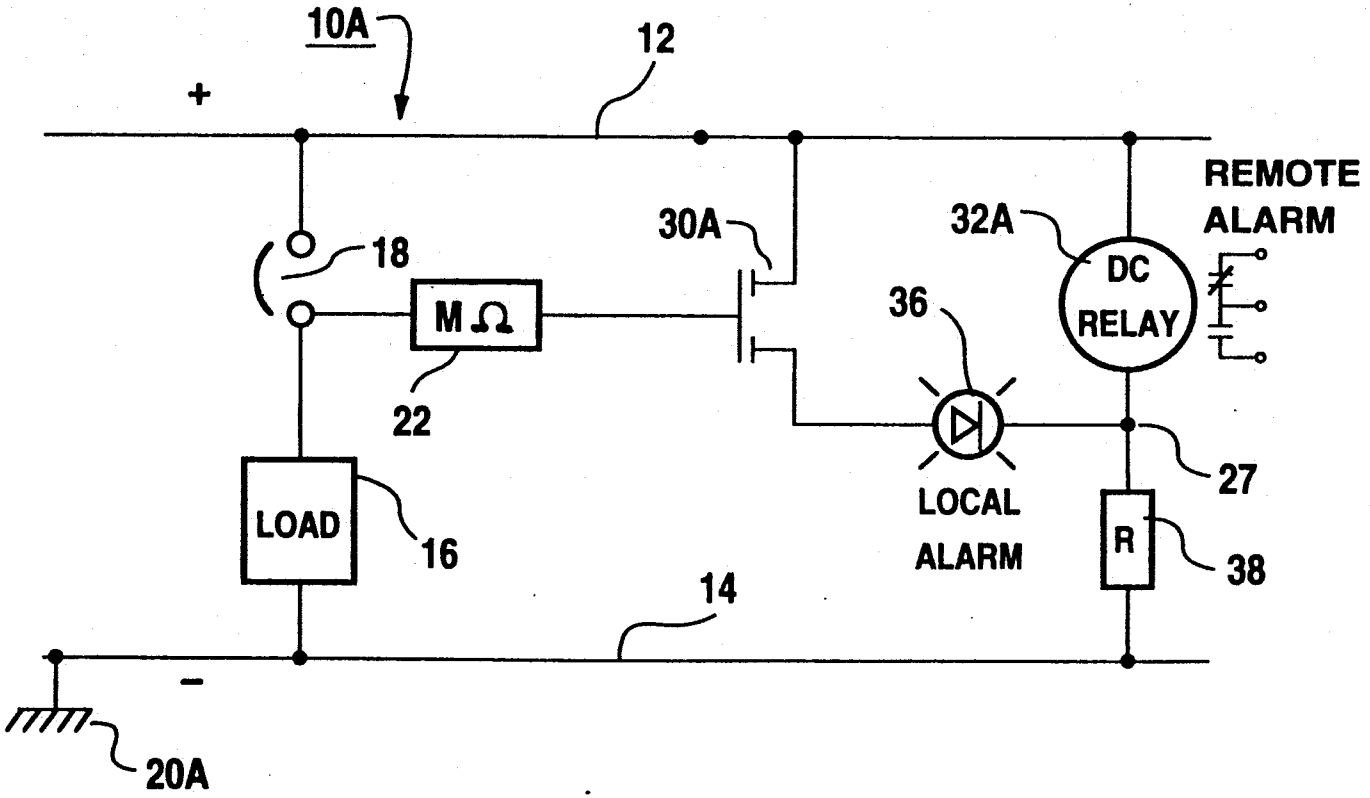
FIG. 6 is similar to FIG. 4, showing an alternative high gain amplifier.

Turning now to FIGS. 5 and 6, they show circuits which are essentially identical to those of FIGS. 2 and 4, except that in each case, the high gain amplifier is a FET 30 or 30A.

Figure 7:
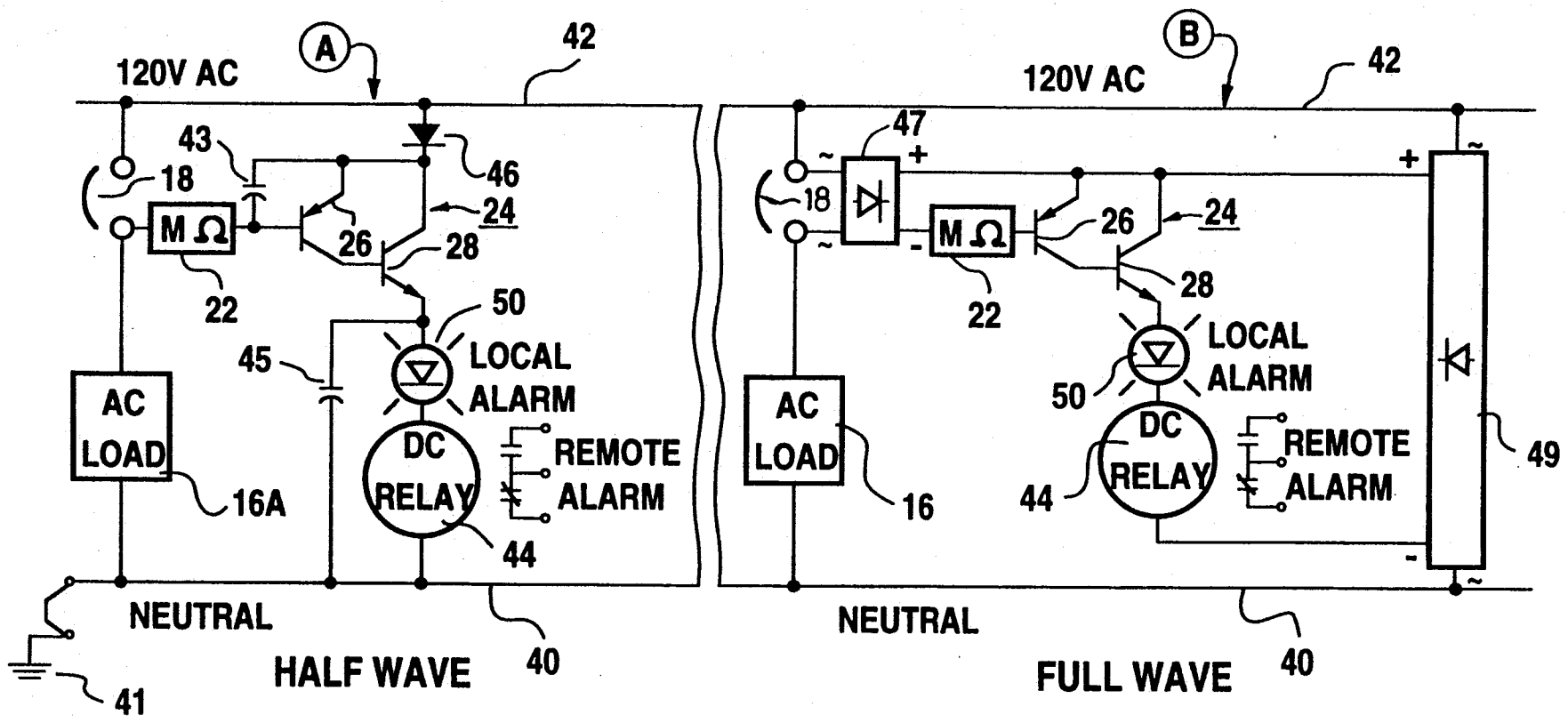
FIG. 7 is a further alternative alarm circuit working in an AC voltage system, showing in part (A) a half wave rectified alarm signal circuit with a DC operating remote signal relay, and in part (B) a full wave rectified alarm signal circuit with a DC operating remote signal relay.

Referring now to FIG. 7, alternative circuits show the operation of an alarm circuit in keeping with the present invention when used with an AC voltage system. Here, the load 16A is connected to the neutral side 40 of the AC system, with the circuit breaker 18 being on the far side of the load connected to the "hot" side 42 of the AC system. The neutral side of the system may generally be connected to ground, as at 41. In the half-wave operating alarm circuit of part (A), the high resistance resistor 22 is connected at one end to the load end of the circuit breaker 18, and at its other end to the input side of the high gain amplifier or solid state switch 24.

It will be noted that in each of part (A) and (B) of FIG. 7, there is a DC relay which operates in series with the output of the high gain amplifier 24. Also, there is a LED 50 which functions as the local alarm, in the same manner as DC relay 32 and LED 34 function in FIGS. 1 and 3, for example. However, the high gain amplifier 24 is a DC operating device, and so a direct current regime must be provided for the alarm circuits.

In part (A) of FIG. 7, a half-wave rectified DC system is arranged, having a diode 46 in series with the high gain amplifier 24, so that in the event the high gain amplifier 24 is required to become conductive due to failure of the circuit breaker 18, it will conduct half-wave rectified DC current. Capacitors 43 and 45 provide for the appropriate filtering. Thus, DC operating devices such as the amplifier 24, the LED 50 and the DC relay 44, may operate in an otherwise DC regime.

In part (B) of FIG. 7, there is shown a full-wave rectified alarm circuit. Here, a full-wave rectifier 47 is connected across the terminals of the circuit breaker 18; and a further full-wave rectifier 49 is connected across AC voltage system from 42 to 40. It will be noted that the positive side of each of the full-wave rectifiers 47 and 49 are connected to each other. The high resistance resistor 22 is connected between the negative side of full-wave rectifier 47 and the base of transistor 26 (the input to high gain amplifier 24). The local alarm LED 50 and the DC relay 44 operate as described above.

Figure 8:
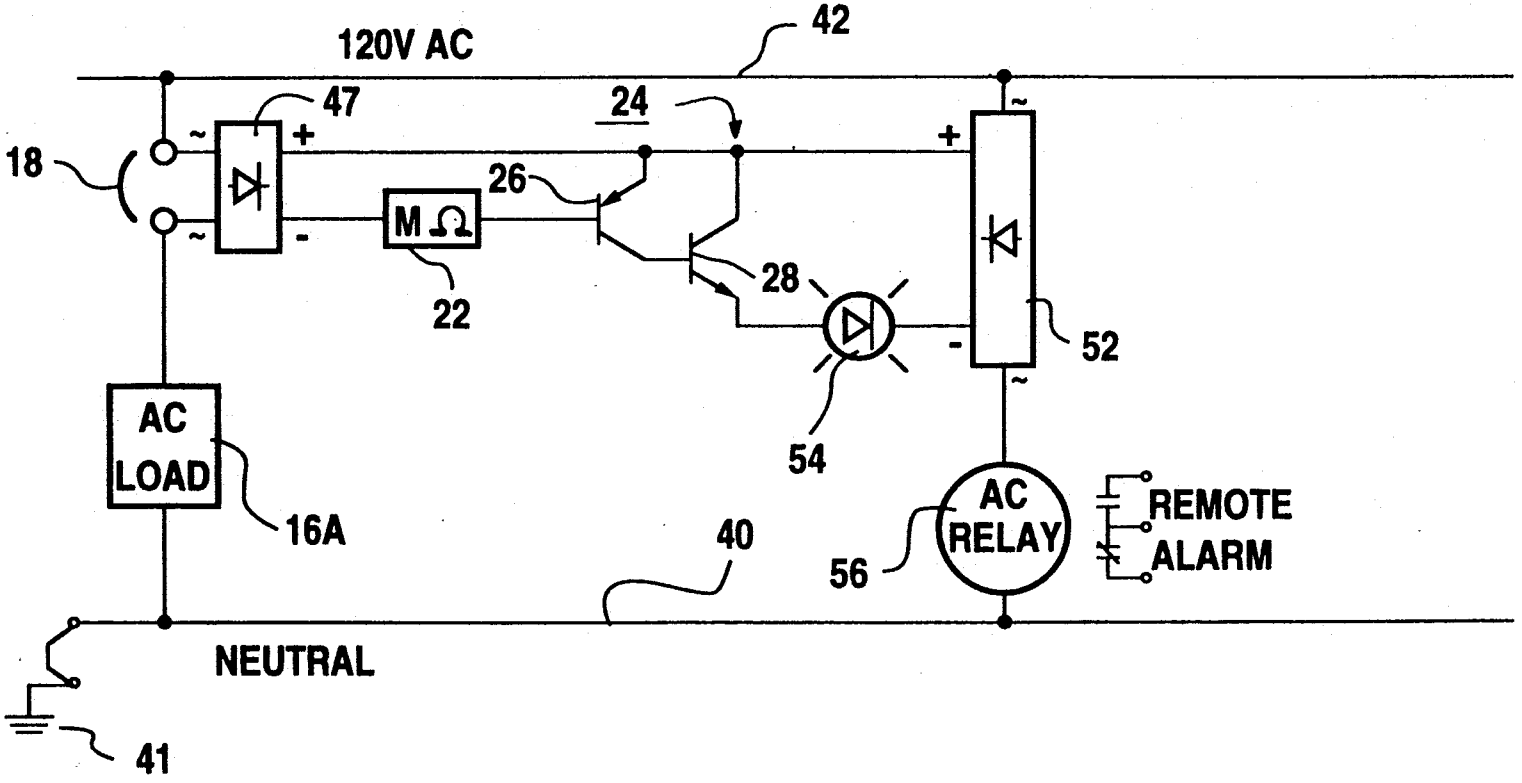
FIG. 8 is a further alternative AC system having a full wave rectified alarm signal circuit and an AC operating remote signal relay.

Turning now to FIG. 8, yet a further modification of part (B) of FIG. 7 is shown. Here, the arrangement is for there to be an AC operating relay 56, which may be powered directly from lines 42 and 40. However, because the alarm circuit must operate in a DC regime, full-wave rectifier 47 is again provided across the terminals of the circuit breaker 18; and a full-wave rectifier 52 is provided across the output of the high gain amplifier 24. Thus, the alarm circuit may function in a DC regime as described above with respect to part (B) of FIG. 7, but an AC relay maybe utilized as the remote signal relay. It will be noted that LED 55 is, in the circumstances, connected to the DC negative terminal of full-wave rectifier 52.

Figure 9:
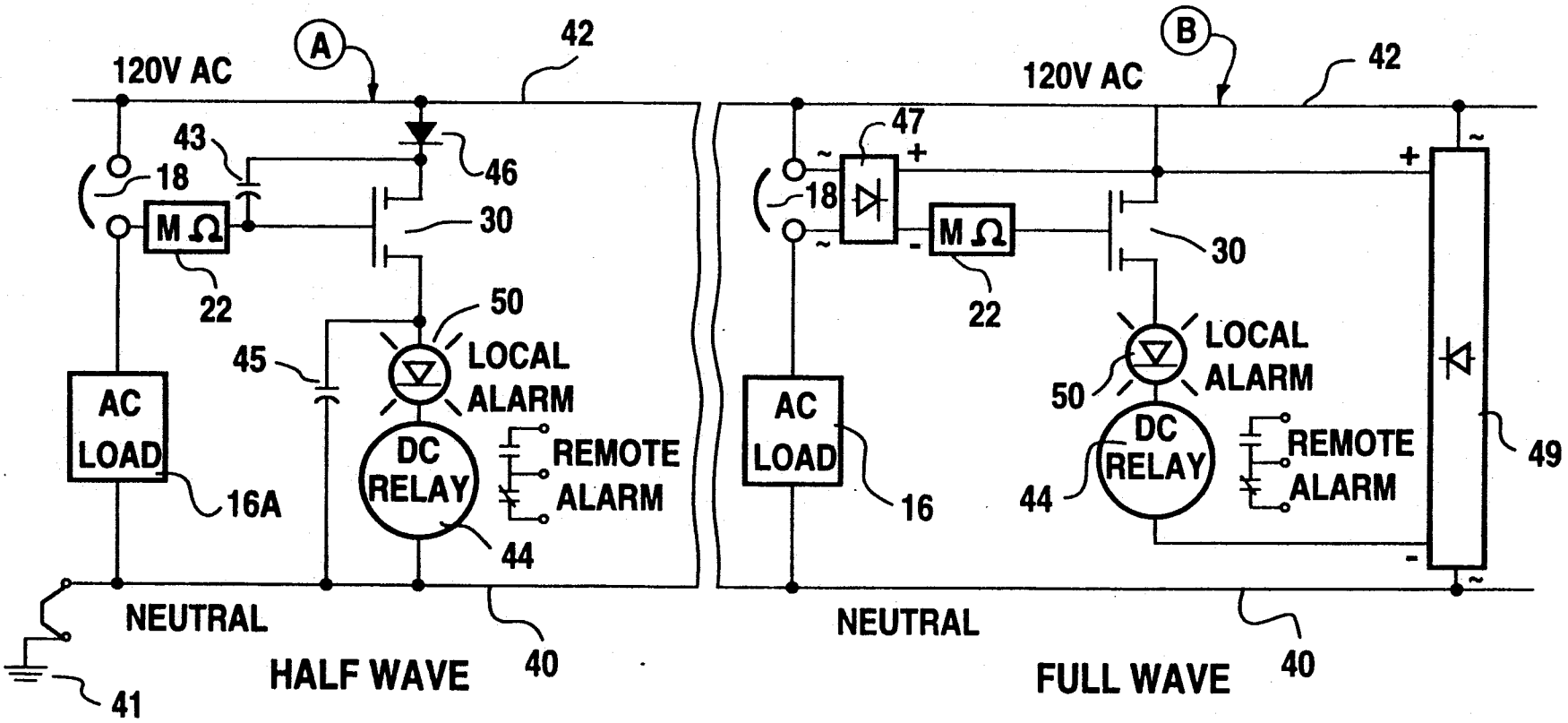
FIG. 9 is similar to FIG. 7, showing alternative high gain amplifiers.
Figure 10:
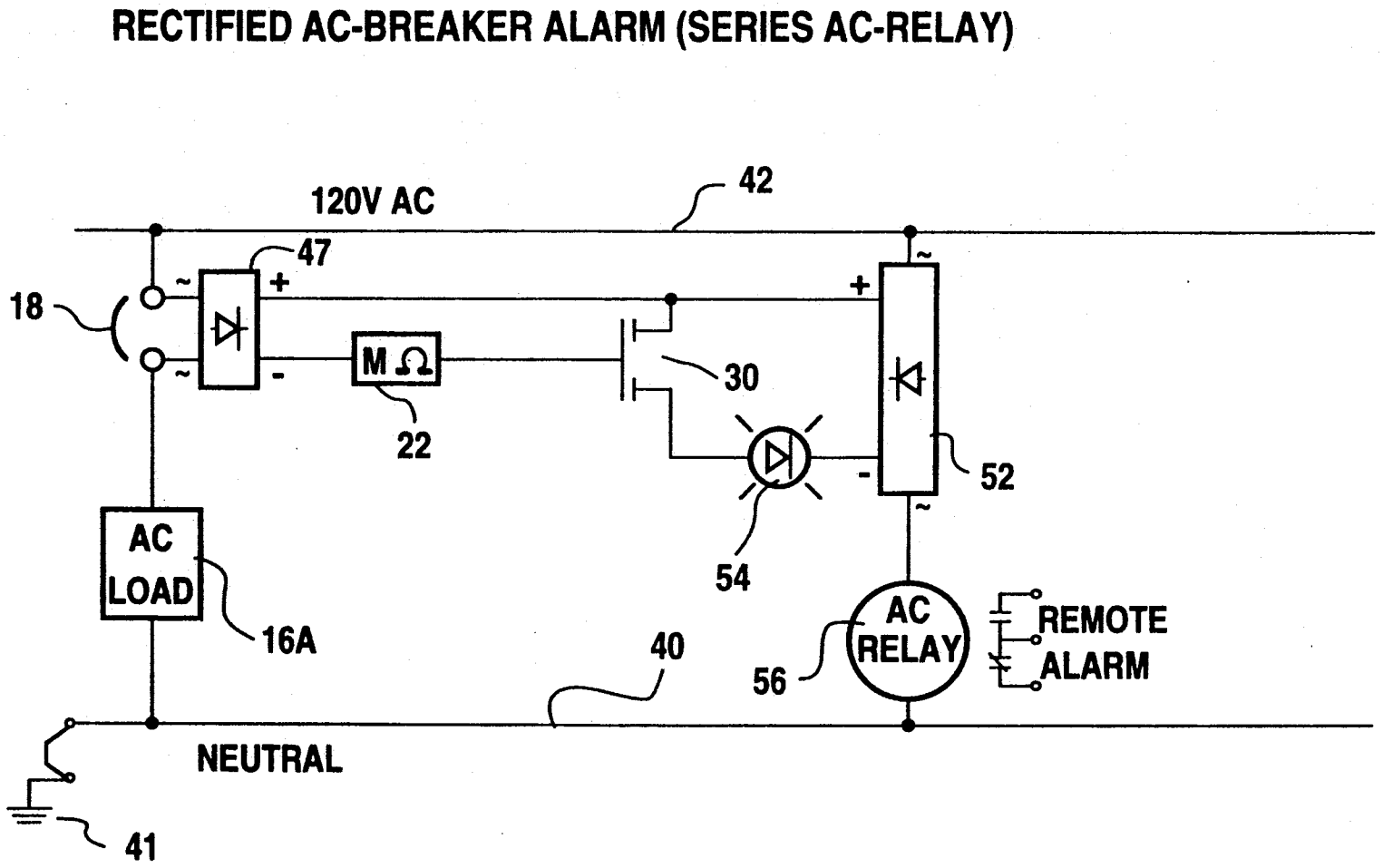
FIG. 10 is similar to FIG. 8, showing an alternative high gain amplifier.

FIGS. 9 and 10 show similar circuit arrangements to those of FIGS. 7 and 8. However, in each instance, the high gain amplifier is shown as a FET 30.

Figure 11:
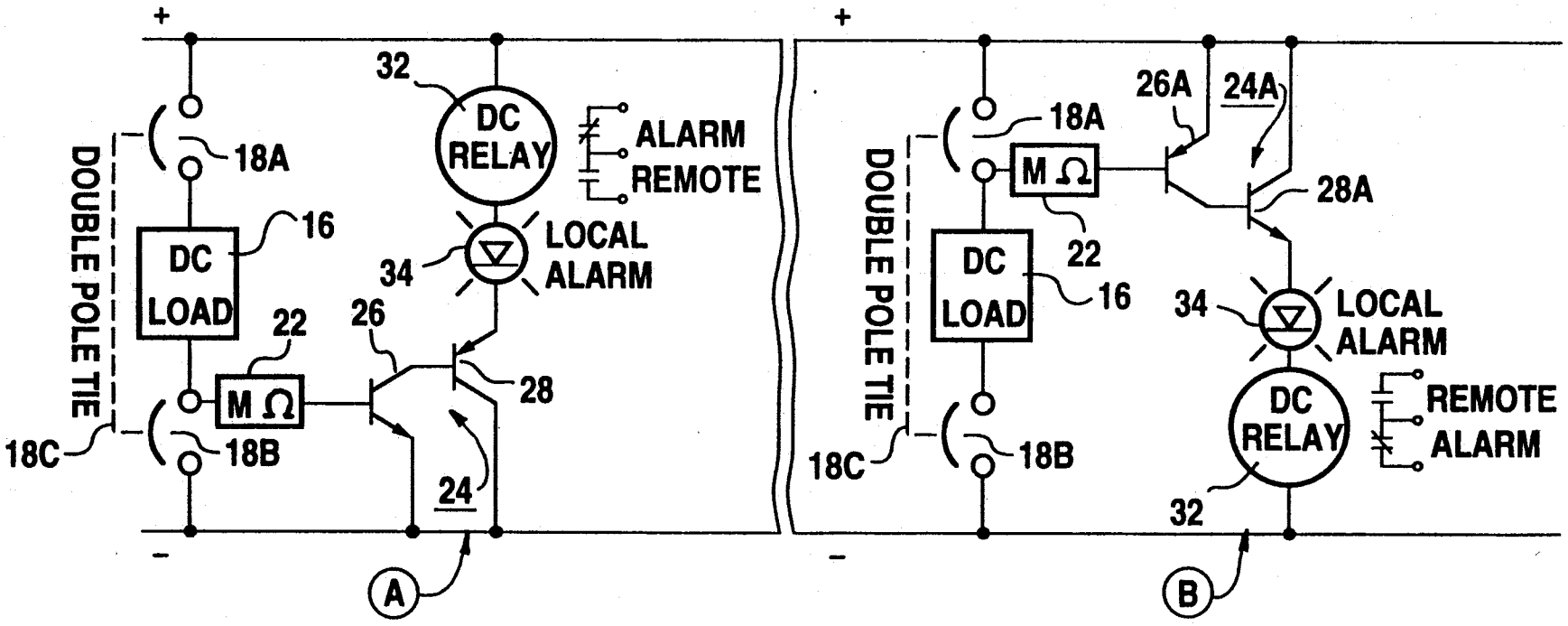
FIG. 11 is a further alternative alarm circuit operating in an ungrounded DC system, with a series DC operating remote signal relay, where part (A) shows the input to the high gain amplifier at the negative side of the circuit, and part (B) shows the input to the high gain amplifier at the positive side of the circuit.
Figure 12:
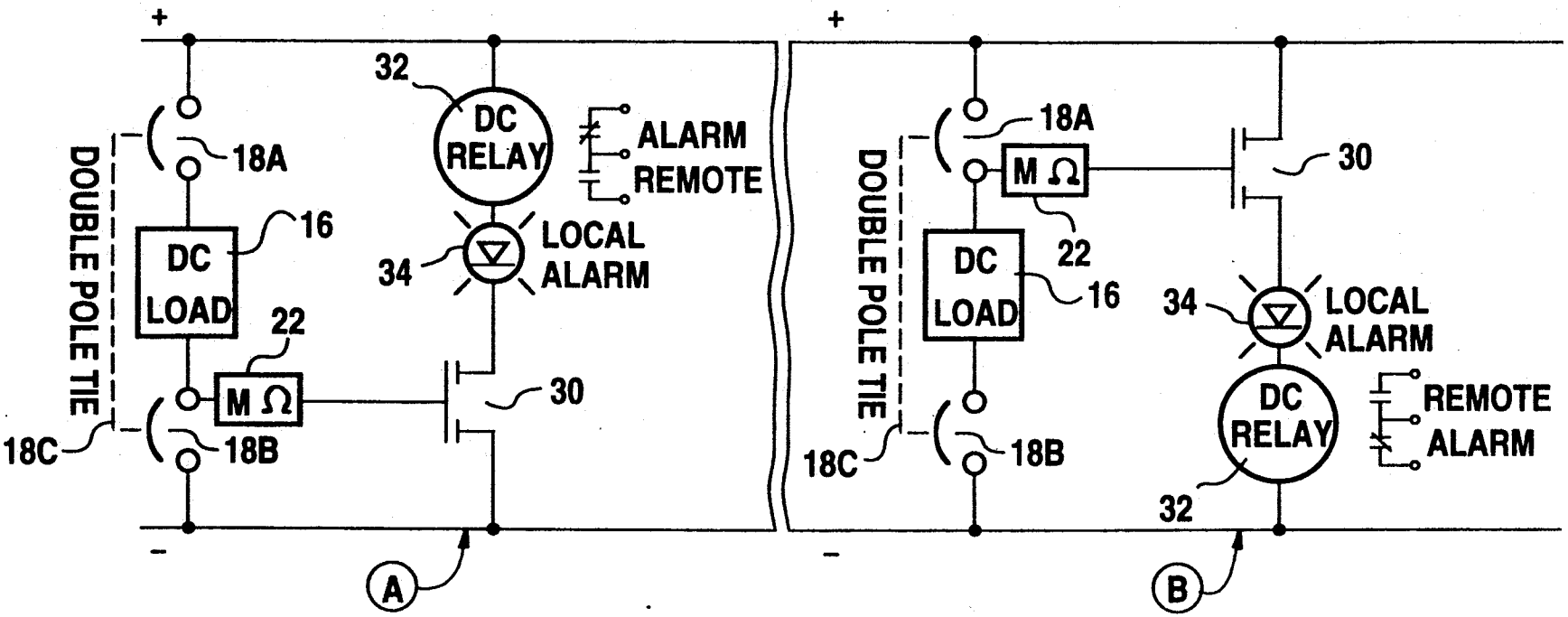
FIG. 12 is similar to FIG. 11, showing alternative high gain amplifiers.

Finally, turning to FIGS. 11 and 12, alternative circuit arrangements are shown for alarm circuits working in an ungrounded—that is, floating—DC environment. In such circumstances as ungrounded DC operating systems, for example, transit systems and the like, the load is protected from the voltage system by a circuit breaker at each side of the load. The circuit breaker is shown at 18A and 18B, and is shown as ganged or tied together by such as a double pole tie 18C. In each of FIGS. 11 and 12, part (A) otherwise shows a system which is not unlike that of FIG. 1; and part (B) shows a system which is not unlike that of FIGS. 2 and 4. However, in each instance, the output of the high gain amplifier 28 or 30 is shown in series with the DC relay 32 and the local alarm LED 34.

In the circuit of FIGS. 11 and 12, if either circuit breaker 18A or circuit breaker 18B opens, then the other circuit breaker will also open, so that the DC load 16 is fully isolated from the voltage system. In that case, the bias is removed from the input of the high gain amplifier 24 or 30 (for example, from the base of transistor 26 or 26A) and the high gain amplifier which has been clamped by the minimal current flowing through the high resistance resistor 22 to a non-conductive condition, switches its state and becomes substantially fully conductive.

The scope of the present invention is defined by the accompanying claims.

I claim:

1. An alarm circuit for use in a voltage system having a load across a voltage and in series with a circuit breaker, wherein said alarm circuit is arranged to provide a status or alarm signal when said circuit breaker has opened; wherein said alarm circuit includes:

a high resistance resistor connected at its first end to the load end of said circuit breaker, and at its second end to the input of a high gain amplifier;

said high gain amplifier having its output connected to a first side of a remote signal relay, a second side of said remote signal relay being connected to one side of said voltage system;

whereby said high gain amplifier is maintained in a non-conductive condition while said circuit breaker remains closed, and is arranged so as to change its state to be substantially fully conductive when said circuit breaker opens;

said remote signal relay being such so as to change its state when said high gain amplifier changes its state to be substantially fully conductive;

and signal means associated with said remote signal relay and arranged so as to give a signal when said remote signal relay changes its state, which signal is indicative of the fact that said circuit breaker has opened;

wherein said second side of said remote signal relay is connected in series connection to a LED and thence to said one side of said voltage system, and said first side of said remote signal relay; whereby when said circuit breaker opens, said LED and said signal means associated with said remote signal relay will each give a signal indicative of the fact that said circuit breaker has opened;

wherein said voltage system is an alternating current system of which one side is a neutral side, and wherein said remote signal relay and said LED are arranged to be in series with said high gain amplifier, across said voltage system;

wherein said remote signal relay is a direct current relay, and is arranged in series with said LED and said high gain amplifier and the negative end of a first diode; wherein the positive end of said diode is connected to the side of said voltage system which is remote from said neutral side of said voltage system, and the series connection of said remote signal relay and said LED are connected to said neutral side; and wherein the side of said load remote from said circuit breaker is also connected to the neutral side of said alternating current system.

2. The alarm circuit of claim 1, wherein said high gain amplifier is a FET.

3. An alarm circuit for use in a voltage system having a load across a voltage and in series with a circuit breaker, wherein said alarm circuit is arranged to provide a status or alarm signal when said circuit breaker has opened; wherein said alarm circuit includes:

a high resistance resistor connected at its first end to the load end of said circuit breaker, and at its second end to the input of a high gain amplifier;

said high gain amplifier having its output connected to a first side of a remote signal relay, a second side of said remote signal relay being connected to one side of said voltage system;

whereby said high gain amplifier is maintained in a non-conductive condition while said circuit breaker remains closed, and is arranged so as to change its state to be substantially fully conductive when said circuit breaker opens;

said remote signal relay being such so as to change its state when said high gain amplifier changes its state to be substantially fully conductive;

and signal means associated with said remote signal relay and arranged so as to give a signal when said remote signal relay changes its state, which signal is indicative of the fact that said circuit breaker has opened;

wherein said second side of said remote signal relay is connected in series connection to a LED and thence to said one side of said voltage system, and said first side of said remote signal relay; whereby when said circuit breaker opens, said LED and said signal means associated with said remote signal relay will each give a signal indicative of the fact that said circuit breaker has opened;

wherein said voltage system is an alternating current system of which one side is a neutral side, and wherein said remote signal relay and said LED are arranged to be in series with said high gain amplifier, across said voltage system;

wherein said remote signal relay is a direct current relay, and is arranged in series with said LED and in series with said high gain amplifier;

wherein a first full wave rectifier is connected across said circuit breaker, and said high resistance resistor is connected in series with a first side of the direct current output of said full wave rectifier;

wherein a second full wave rectifier is connected across said voltage system;

wherein said high gain amplifier, said LED, and said remote signal relay are connected in series across said second full wave rectifier;

wherein a second side of said first full wave rectifier which is opposite said first side thereof, and the side of said second full wave rectifier having the same polarity as said second side of said first full wave rectifier are connected together; and wherein the side of said load remote from said circuit breaker is also connected to the neutral side of said alternating current system.

4. The alarm circuit of claim 3, wherein said high gain amplifier is a FET.

5. An alarm circuit for use in a voltage system having a load across a voltage and in series with a circuit breaker, wherein said alarm circuit is arranged to provide a status or alarm signal when said circuit breaker has opened; wherein said alarm circuit includes:

a high resistance resistor connected at its first end to the load end of said circuit breaker, and at its second end to the input of a high gain amplifier;

said high gain amplifier having its output connected to a first side of a remote signal relay, a second side of said remote signal relay being connected to one side of said voltage system;

whereby said high gain amplifier is maintained in a non-conductive condition while said circuit breaker remains closed, and is arranged so as to change its state to be substantially fully conductive when said circuit breaker opens;

said remote signal relay being such so as to change its state when said high gain amplifier changes its state to be substantially fully conductive;

and signal means associated with said remote signal relay and arranged so as to give a signal when said remote signal relay changes its state, which signal is indicative of the fact that said circuit breaker has opened;

wherein said second side of said remote signal relay is connected in series connection to a LED and thence to said one side of said voltage system, and said first side of said remote signal relay; whereby when said circuit breaker opens, said LED and said signal means associated with said remote signal relay will each give a signal indicative of the fact that said circuit breaker has opened;

wherein said voltage system is an alternating current system of which one side is a neutral side, and wherein said remote signal relay and said LED are arranged to be in series with said high gain amplifier, across said voltage system;

wherein a first full wave rectifier is connected across said circuit breaker, and said high resistance resistor is connected in series with a first side of said full wave rectifier;

wherein said remote signal relay is an alternating current relay, and is arranged in series with a second full wave rectifier;

wherein a first side of said second full wave rectifier is connected to a first side of said high gain amplifier and to the side of said first full wave rectifier having the same polarity, said same polarity said being opposite to said first side of said first full wave rectifier to which said high resistance resistor is connected; and the second side of said second full wave rectifier is connected to said LED, and said LED is connected to a second side of said high gain amplifier;

wherein the side of said load remote from said circuit breaker is connected to the neutral side of said alternating current system; and wherein the side of said remote signal relay remote from said full wave rectifier is also connected to the neutral side of said alternating current system.

6. The alarm circuit of claim 5, wherein said high gain amplifier is a FET.

* * * * *